US010722048B2

(12) United States Patent
Peterson et al.

(10) Patent No.: US 10,722,048 B2
(45) Date of Patent: Jul. 28, 2020

(54) INFANT SUPPORT PILLOW

(71) Applicant: KIDS II, INC., Atlanta, GA (US)

(72) Inventors: Eden Peterson, Alpharetta, GA (US); Hayley Jackson, Atlanta, GA (US); Alison Wright, Cumming, GA (US); Anjum Mohyuddin, Brookhaven, GA (US)

(73) Assignee: KIDS2, INC., Atlanta, GA (US)

( * ) Notice: Subject to any disclaimer, the term of this patent is extended or adjusted under 35 U.S.C. 154(b) by 938 days.

(21) Appl. No.: 15/099,167

(22) Filed: Apr. 14, 2016

(65) Prior Publication Data

US 2016/0302589 A1 Oct. 20, 2016

Related U.S. Application Data

(60) Provisional application No. 62/216,307, filed on Sep. 9, 2015, provisional application No. 62/215,829, filed on Sep. 9, 2015, provisional application No. 62/215,820, filed on Sep. 9, 2015, provisional application No. 62/215,802, filed on Sep. 9, 2015, provisional application No. 62/197,806, filed on Jul. 28, 2015, provisional application No. 62/152,848, filed on Apr. 25, 2015, provisional application No. 62/148,388, filed on Apr. 16, 2015.

(51) Int. Cl.
*A47D 13/08* (2006.01)

(52) U.S. Cl.
CPC ..... *A47D 13/08* (2013.01); *A47D 13/083* (2013.01)

(58) Field of Classification Search
CPC ..... A47G 2009/1018; A47G 9/10; A47G 9/1009; A47G 9/1027; A47G 9/1045; A47G 9/1072; A47G 9/109; A61G 13/121; A61G 7/072
See application file for complete search history.

(56) References Cited

U.S. PATENT DOCUMENTS

| | | | |
|---|---|---|---|
| 909,453 | A | 1/1909 | Pullman |
| 1,590,927 | A | 6/1926 | Duncan et al. |
| 1,846,748 | A | 2/1932 | Palmer |
| 1,867,422 | A | 7/1932 | Shapiro |
| 2,404,505 | A | 7/1946 | Knecht |
| D160,223 | S | 9/1950 | Smith |
| D171,536 | S | 2/1954 | Flanagin |
| D171,752 | S | 3/1954 | Dardenelle |
| D174,996 | S | 6/1955 | Peters |
| 2,877,472 | A | 3/1959 | Wagner |
| 2,961,668 | A | 11/1960 | Hayes |
| D190,184 | S | 4/1961 | Shurtleff |
| 3,104,011 | A | 9/1963 | Bowman |

(Continued)

*Primary Examiner* — Eric J Kurilla
(74) *Attorney, Agent, or Firm* — Gardner Groff & Greenwald, PC

(57) ABSTRACT

An infant support pillow for supporting an infant or small child in a lying or seated position comprising a pillow shell and a resilient fill material that defines a recessed center portion surrounded partially or fully by a raised perimeter portion. The pillow shell can comprise various features, including fabric types, attachments, appliqués and stitching, configured to represent an object or character. The recessed center portion and the raised peripheral portion are configured such that the infant is comfortably and stably supported at an incline.

6 Claims, 9 Drawing Sheets

(56) References Cited

U.S. PATENT DOCUMENTS 3,400,413 A 9/1968 Grossa
3,840,916 A 10/1974 Jennings
D243,736 S 3/1977 Ishizuka
4,197,604 A 4/1980 Nakamura
D254,891 S 5/1980 Mills
D256,414 S 8/1980 Rich
D284,056 S 6/1986 Kinsley
D286,358 S 10/1986 Thomas et al.
D294,099 S 2/1988 Bromberg et al.
4,763,369 A 8/1988 Spector
4,768,247 A 9/1988 Beier
D298,198 S 10/1988 O'Sullivan
4,776,049 A 10/1988 Perron
D300,681 S 4/1989 DeMars
4,826,006 A 5/1989 Chainard
4,832,648 A 5/1989 Theobald et al.
4,889,512 A 12/1989 Burnett et al.
D305,288 S 1/1990 Eldridge
4,909,573 A 3/1990 Barry et al.
D309,391 S 7/1990 King et al.
D309,688 S 8/1990 Hashimoto
D312,208 S 11/1990 Sorkin
4,980,937 A 1/1991 Mason et al.
5,027,457 A 7/1991 Sweet
D322,723 S 12/1991 Barry et al.
5,088,141 A * 2/1992 Meyer ..... A47G 9/10 5/636
5,095,567 A 3/1992 Kenoyer
5,112,104 A 5/1992 De Giacomi
5,115,528 A 5/1992 Lamle
5,137,335 A 8/1992 Marten
5,184,362 A 2/1993 Yager et al.
D335,605 S 5/1993 Roberts
D336,789 S 6/1993 Yang
5,261,134 A 11/1993 Matthews
5,279,237 A 1/1994 Alivizatos
D348,168 S 6/1994 Keller
D348,170 S 6/1994 Keller
D348,171 S 6/1994 Keller
D348,172 S 6/1994 Keller
D348,372 S 7/1994 Keller
5,354,118 A 10/1994 Barry
D352,633 S 11/1994 Berggren
5,363,524 A * 11/1994 Lang ..... A47G 9/1081 5/640
5,507,551 A 4/1996 Barry
5,509,157 A 4/1996 Story
5,519,906 A 5/1996 Fanto-Chan
D372,392 S 8/1996 Bala
5,546,620 A 8/1996 Matthews
D373,920 S 9/1996 Stephan
5,551,749 A 9/1996 Reher et al.
D375,557 S 11/1996 Dixon
D381,233 S 7/1997 Torbik
D383,026 S 9/1997 Torbik
D383,635 S 9/1997 Bear
5,661,861 A 9/1997 Matthews
D387,234 S 12/1997 Keller
D387,935 S 12/1997 Wisler
5,699,569 A 12/1997 Schwarz-Zohrer
5,708,998 A 1/1998 Torbik
D390,057 S 2/1998 Gower
D392,829 S 3/1998 Bear
D397,900 S 9/1998 Besen
D397,901 S 9/1998 Williams
5,813,066 A 9/1998 Gebhard et al.
D407,938 S 4/1999 Bear
D407,941 S 4/1999 Lewis et al.
D408,197 S 4/1999 Bear
D408,199 S 4/1999 Lewis et al.
D408,200 S 4/1999 Lewis et al.
D408,671 S 4/1999 Bear
D408,672 S 4/1999 Bear
D408,675 S 4/1999 Lewis et al.
D409,871 S 5/1999 Lewis et al.
D410,166 S 5/1999 Bear
D410,167 S 5/1999 Bear
D411,934 S 7/1999 Lewis et al.
6,006,381 A 12/1999 Tandrup
D418,637 S 1/2000 Bionde et al.
6,026,330 A 2/2000 Chuang
6,029,296 A * 2/2000 Terrell ..... A47D 13/08 5/485
D421,511 S 3/2000 Bionde et al.
6,038,720 A 3/2000 Matthews et al.
6,055,687 A 5/2000 Matthews
6,119,873 A 9/2000 Matthews
6,126,240 A 10/2000 Tse
D433,863 S 11/2000 Rosenstadt et al.
D434,261 S 11/2000 Rosenstadt et al.
6,216,298 B1 4/2001 Oliveira
D441,585 S 5/2001 Strauser
6,233,767 B1 5/2001 Horowitz
D443,461 S 6/2001 Hall et al.
D444,981 S 7/2001 Hall et al.
D445,623 S 7/2001 Hartner
6,279,185 B1 8/2001 Matthews
D450,517 S 11/2001 Darling et al.
6,321,403 B1 11/2001 Matthews
D457,316 S 5/2002 Swade
6,412,128 B1 7/2002 Matthews
6,427,265 B1 8/2002 Dix
6,434,769 B1 8/2002 Koenig
6,434,770 B2 8/2002 Matthews Brown
6,453,493 B1 9/2002 Matthews Brown
6,484,337 B1 11/2002 Moe et al.
6,494,532 B1 12/2002 Brosnan et al.
6,499,165 B1 12/2002 Morgillo
6,523,200 B2 2/2003 Brown
6,532,612 B2 3/2003 Matthews Brown
6,539,567 B1 4/2003 Bae
6,553,590 B1 4/2003 Leach
6,560,802 B2 5/2003 Fujii
6,574,810 B2 6/2003 Mangiaracina
6,598,248 B1 7/2003 Ong
6,625,828 B2 9/2003 Matthews Brown
6,640,977 B2 11/2003 Matthews Brown et al.
6,651,282 B1 11/2003 Skoug et al.
6,658,681 B2 12/2003 Britto et al.
6,671,908 B2 1/2004 Brown et al.
6,685,024 B1 2/2004 Matthews
D490,991 S 6/2004 Desnos
6,763,539 B1 7/2004 Bartley et al.
6,810,545 B1 11/2004 Darling et al.
6,851,143 B2 2/2005 Matthews Brown
6,857,150 B2 2/2005 Matthews Brown et al.
D502,351 S 3/2005 Goodchild
6,892,406 B2 5/2005 Littlehorn
6,922,861 B1 8/2005 Mathis
6,931,682 B2 8/2005 Kruger, Jr.
6,944,898 B2 9/2005 Matthews Brown et al.
7,000,273 B2 2/2006 Rivera-Wienhold et al.
7,000,274 B2 2/2006 Matthews Brown et al.
7,000,275 B2 2/2006 Matthews Brown et al.
7,000,766 B2 2/2006 Matthews Brown et al.
7,014,363 B2 3/2006 Hanson
7,017,212 B2 3/2006 Matthews Brown
D520,798 S 5/2006 Keller
D521,299 S 5/2006 Keller
D521,792 S 5/2006 Keller
7,047,678 B1 5/2006 Hall et al.
D522,788 S 6/2006 Keller
D523,677 S 6/2006 Keller
7,055,196 B2 6/2006 Littlehorn
7,089,639 B2 8/2006 Matthews Brown et al.
D528,339 S 9/2006 Keller
7,127,760 B2 10/2006 Bartley et al.
7,146,663 B2 12/2006 Brown et al.
7,152,263 B1 * 12/2006 Delfs ..... A47G 9/10 5/636
D543,065 S 5/2007 Kent
7,227,965 B1 6/2007 Sutton
D545,605 S 7/2007 Keller
D547,587 S 7/2007 Keller

(56) References Cited

U.S. PATENT DOCUMENTS 7,252,330 B2 8/2007 Lincoln
7,257,916 B2 8/2007 Hall et al.
D551,889 S 10/2007 Keller
7,290,303 B2 11/2007 Mead et al.
7,331,073 B2 2/2008 Littlehorn et al.
7,404,222 B2 7/2008 Tidwell
7,430,765 B2 10/2008 Brown et al.
7,430,774 B2 10/2008 Littlehorn et al.
7,451,508 B2 11/2008 Matthews Brown et al.
7,472,443 B2 1/2009 Littlehorn et al.
D589,683 S 4/2009 Knab
7,516,569 B2 4/2009 Garcia
7,562,406 B1 7/2009 Leach
7,587,773 B2 9/2009 Littlehorn et al.
7,624,461 B2 12/2009 Tidwell et al.
7,657,955 B1 2/2010 Alvistur et al.
D610,853 S 3/2010 Straub
7,676,871 B1 3/2010 Leach
7,722,357 B2 5/2010 Payette-Hebert et al.
D622,087 S 8/2010 Carr et al.
7,780,354 B2 8/2010 Funaki et al.
7,788,752 B2 9/2010 Tidwell et al.
7,810,191 B2 10/2010 Littlehorn et al.
7,832,036 B2 11/2010 Littlehorn et al.
7,862,115 B1 1/2011 Davis
7,900,303 B2 3/2011 Mastrosimone-Gese
D640,549 S 6/2011 Atkin et al.
8,205,284 B2 6/2012 Mastrosimone-Gese
D666,907 S 9/2012 Dowden et al.
D672,994 S 12/2012 Randall
D672,995 S 12/2012 Diaz
8,321,977 B1 12/2012 Kummerfeld et al.
D673,406 S 1/2013 Randall
D673,407 S 1/2013 Randall
D673,408 S 1/2013 Randall
D674,973 S 1/2013 Grainer
8,341,782 B2 1/2013 Abrahams
8,460,053 B2 6/2013 Fair et al.
8,468,627 B2 6/2013 Leach
D686,435 S 7/2013 Randall
8,485,601 B2 7/2013 Fair et al.
8,495,775 B2 7/2013 Fair et al.
8,516,638 B2 8/2013 Kummerfeld et al.
8,550,548 B2 10/2013 Gibbons et al.
8,550,866 B2 10/2013 Wadhwani
8,555,429 B2 10/2013 Leach
8,595,872 B2 12/2013 Tidwell
D699,982 S 2/2014 Fair et al.
8,650,663 B2 2/2014 Fair et al.
8,672,724 B2 3/2014 Beuerle
8,696,400 B2 4/2014 Fair et al.
8,763,183 B2 7/2014 Tidwell
8,764,109 B2 7/2014 Kummerfeld et al.
8,863,334 B2 10/2014 Gibbons et al.
8,882,557 B2 11/2014 Fair et al.
8,943,626 B1 2/2015 Stephens
8,950,029 B2 2/2015 Tidwell
8,950,808 B2 2/2015 Kummerfeld et al.
D726,449 S 4/2015 Faley et al.
D730,171 S 5/2015 Plourde et al.
9,113,719 B2 8/2015 Kummerfeld et al.
9,155,409 B2 10/2015 Cohen
9,247,830 B2 2/2016 Waters et al.
2001/0008214 A1 7/2001 Matthews
2002/0133881 A1 9/2002 Vrbas et al.
2003/0092354 A1 5/2003 Wexler
2003/0151283 A1 8/2003 Pogue et al.
2004/0154104 A1 8/2004 Brown et al.
2004/0261180 A1 12/2004 Birns
2005/0000992 A1 1/2005 Mead
2005/0053315 A1 3/2005 Aasen
2005/0110315 A1 5/2005 Littlehorn et al.
2005/0150050 A1 7/2005 Wolf et al.
2005/0210592 A1 9/2005 Littlehorn et al.
2005/0225137 A1 10/2005 Mead et al.
2006/0016011 A1* 1/2006 Berg ..... A47G 9/10 5/636
2007/0017031 A1 1/2007 Kaplan
2007/0204402 A1 9/2007 Harris et al.
2008/0011747 A1 1/2008 Anderson et al.
2008/0182478 A1 7/2008 Smoot et al.
2009/0007335 A1 1/2009 Tidwell
2009/0176437 A1 7/2009 Jaqua et al.
2010/0319133 A1 12/2010 Whitlock et al.
2011/0154572 A1 6/2011 Fair et al.
2011/0163520 A1 7/2011 Fair et al.
2012/0073058 A1 3/2012 Sclare et al.
2012/0106877 A1 5/2012 Tang
2012/0108137 A1 5/2012 Sutton
2012/0151657 A1 6/2012 Gibbons et al.
2012/0187182 A1 7/2012 Howell et al.
2012/0278991 A1 11/2012 Bonzer et al.
2012/0278994 A1 11/2012 Bonzer et al.
2012/0284925 A1 11/2012 Bennett
2012/0289116 A1* 11/2012 Beuerle ..... A47G 9/0253 446/72
2013/0198963 A1 8/2013 Sclare et al.
2014/0015294 A1 1/2014 Sadler-Vandeplas et al.
2014/0020184 A1* 1/2014 Loth ..... A47G 9/1081 5/640
2014/0159446 A1 6/2014 Fair et al.
2014/0352069 A1* 12/2014 Verde Sanchez ..... A61G 7/072 5/636
2015/0067966 A1 3/2015 Gibbons et al.
2015/0289687 A1* 10/2015 Day ..... A47G 9/1045 5/490
2016/0051431 A1* 2/2016 Staats ..... A61G 7/072 128/845

* cited by examiner

INFANT SUPPORT PILLOW

CROSS-REFERENCE TO RELATED APPLICATIONS

This application claims the benefit of U.S. Provisional Patent Application Ser. No. 62/148,388 filed Apr. 16, 2015, U.S. Provisional Patent Application Ser. No. 62/152,848 filed Apr. 25, 2015, U.S. Provisional Patent Application Ser. No. 62/197,806 filed Jul. 28, 2015, U.S. Provisional Patent Application Ser. No. 62/215,802 filed Sep. 9, 2015, U.S. Provisional Patent Application Ser. No. 62/215,820 filed Sep. 9, 2015, U.S. Provisional Patent Application Ser. No. 62/215,829 filed Sep. 9, 2015 and U.S. Provisional Patent Application Ser. No. 62/216,307 filed Sep. 9, 2015, the entireties of which are hereby incorporated herein by reference for all purposes.

TECHNICAL FIELD

The present invention relates generally to the field of pillows, and more particularly to infant support pillows.

BACKGROUND

Infants and young children can need support when lying in a supine or prone position or when sitting upright. It is also common that when a caregiver is nursing or bottle feeding an infant, they can have trouble supporting the weight of the infant on their arm. Known infant support pillows leave room for improvements in this area.

Accordingly, it can be seen that needs exist for an improved device which can support an infant lying in a supine or prone position or sitting up. There also exists a need for an improved device which can support an infant during feeding. It is to the provision of an infant support pillow meeting these and other needs that the present invention is primarily directed.

SUMMARY

In example embodiments, the present invention provides an infant support pillow for supporting an infant or small child in a lying or seated position comprising a pillow shell and a resilient fill material that defines a recessed center portion surrounded partially or fully by a raised perimeter portion.

In one aspect, the present invention relates to an infant support pillow comprising a pillow shell including an upper surface and a lower surface, and a resilient fill material contained within the shell, wherein the shell and fill material form a raised peripheral portion extending about at least a portion of a periphery of the pillow, wherein at least a portion of the shell upper surface is configured to resemble a character or object, and wherein the shell lower surface is generally flat such that the shell lower surface rests generally flush on a support surface.

In another aspect, the invention relates to an infant support pillow comprising an enclosure including an upper surface and a lower surface, and a resilient fill material contained within the enclosure, wherein a center portion of the upper surface is attached to a corresponding center portion of the lower surface forming a recessed area in the upper surface and a cavity in the lower surface, and further comprising an insert containing an insert fill material, wherein the insert is positioned within the lower surface cavity, wherein the insert fill material is positioned within the cavity.

In still another aspect, the invention relates to an infant support pillow package assembly comprising an infant support pillow comprising an upper surface, a lower surface and an outer peripheral end extending therebetween, a tray comprising at least a front wall, a back wall, and a connection therebetween, wherein the tray is configured to receive at least a portion of the infant support pillow in a generally vertical orientation standing on a portion of the peripheral end and a bag configured to receive and contain the infant support pillow and tray, wherein the bag and tray are configured to support the infant support pillow in a vertical position resting on its outer peripheral end.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

Figure 1:
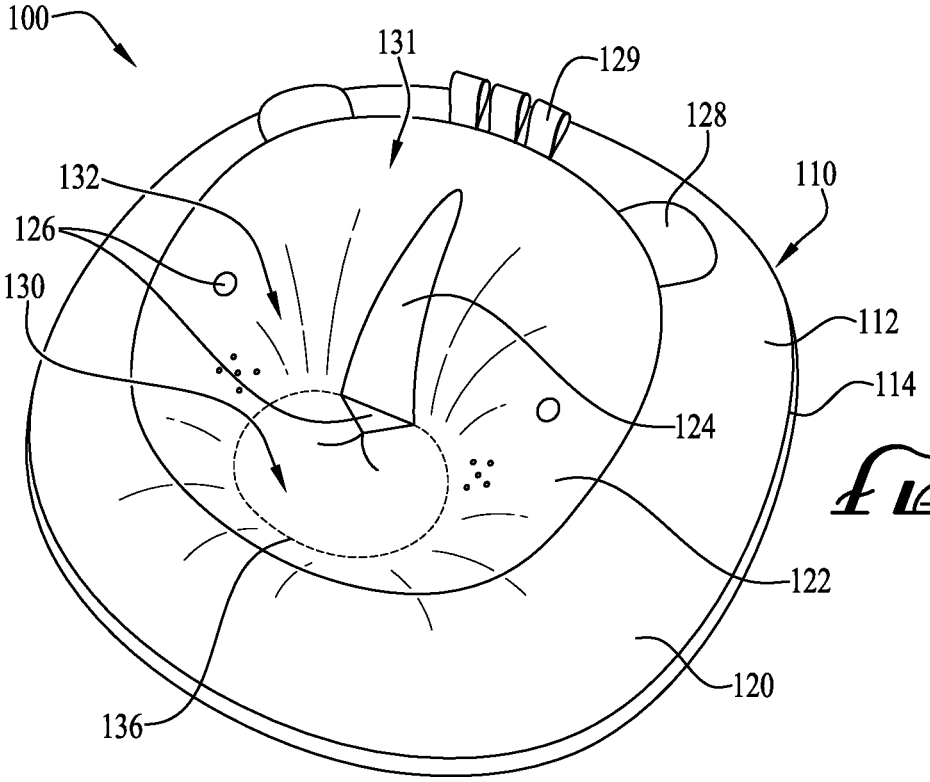
FIG. 1 is a perspective view of an infant support pillow according to an example embodiment of the present invention.

The present invention can be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges can be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-13 generally show various embodiments of an infant child support pillow for supporting an infant or small child. In example embodiments, the pillow comprises a recessed center portion or area surrounded partially or fully by a raised perimeter portion surrounded by an outer shell. The recessed center portion is configured to support the buttocks of a child and the raised periphery portion is configured to support the child's torso, neck and head. The shell comprises design elements configured to represent aspects of a character or object.

Figure 2:
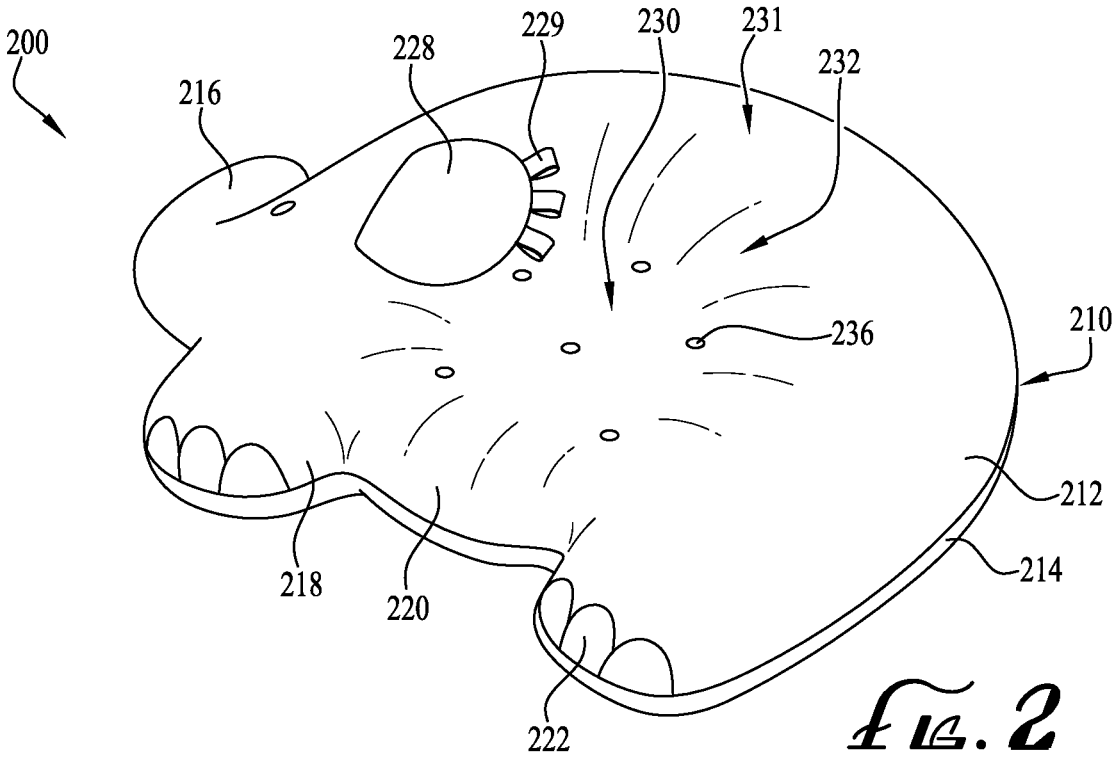
FIG. 2 is a perspective view of an infant support pillow according to another example embodiment of the present invention.
Figure 3:
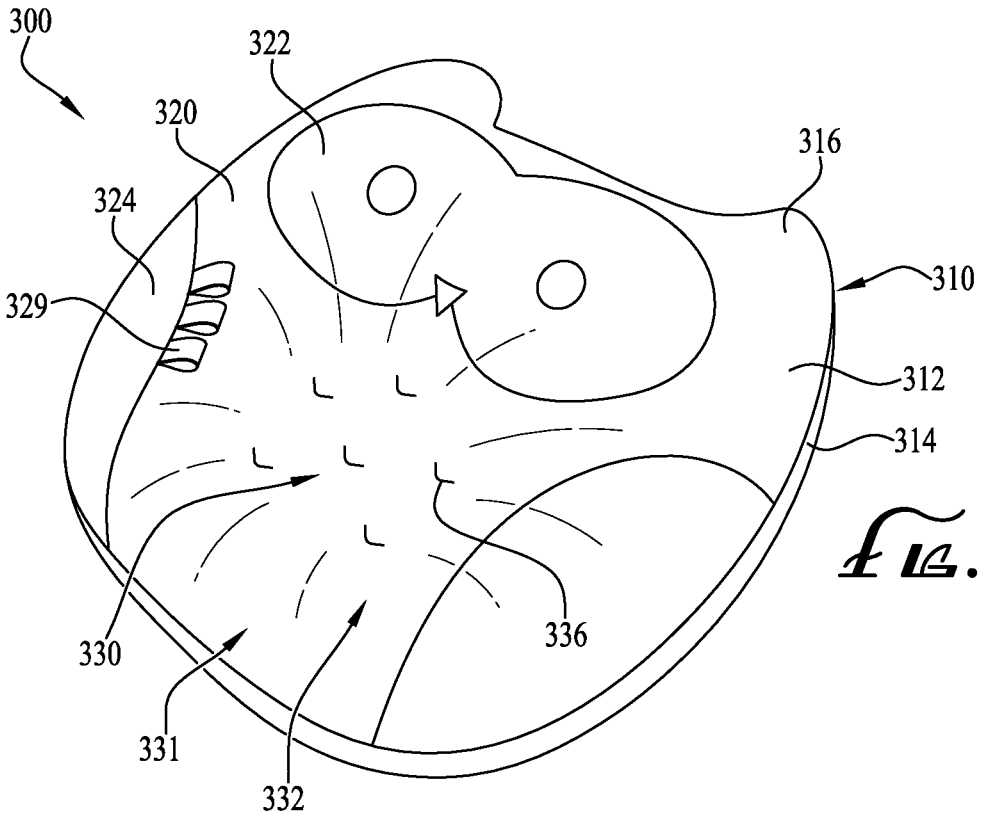
FIG. 3 is a perspective view of an infant support pillow according to another example embodiment of the present invention.

FIGS. 1-3 show infant support pillows 100, 200, 300 according to example embodiments of the invention. As shown in FIG. 1, the pillow 100 includes an outer shell 110, which contains a resilient fill material, shown in FIG. 9. The pillow 100 is generally disc-shaped. The shell 110 is defined by an upper surface 112, an opposing lower surface 114, and an outer peripheral end extending therebetween. The shell lower surface 114 is generally flat such that the lower surface rests generally flush on a support surface, for example, the floor. Major portions of the upper surface 112 are configured to support an infant. The upper surface 112 defines a recessed area 130 generally in its center, creating a seat area to support a portion of the infant or child. The recessed portion 130 is fully or partially surrounded by a raised periphery portion. The recessed area 130 and the raised periphery portion 131 are connected by an inclined transition portion 132. The pillow shell 110 can be made of conventional fabrics including, but not limited to, polyester, plush polyester, cotton, linen, pongee, satin, silk, crinkle material, and other woven or non-woven materials.

In example embodiments, the pillow shell 110 fabric can be configured to resemble a character or object, specifically an animal. For example, as shown in FIG. 1, the upper surface 112 of the shell 110 of the infant support pillow 100 is configured to represent a lion. The upper surface 112 comprises a plurality of different fabric pieces arranged to represent aspects of the lion. For example, a first piece of fabric 120 represents the lion's mane, a second piece of fabric 122 represents the lion's face, and a third piece of fabric 124 represents the lion's nose. Preferably, the three fabrics 120, 122, 124 have different textures and/or colors to engage an infant and assist in child development. In FIG. 2, the infant support pillow 200 is configured to resemble an elephant with a plurality of fabric pieces of different textures and/or colors. For example, a first piece of fabric 220 represents the body of the elephant and a second type of fabric 222 is used to depict the elephant's toes. In FIG. 3, the infant support pillow 300 is configured to represent an owl, with a plurality of fabric pieces of different textures and/or colors. For example, a first piece of fabric 320 represents the owl's head and body, a second piece of fabric 322 represents the owl's eyes, and a third type of fabric 324 represents the owl's wings.

In the depicted embodiments, the lower surface 114, 214, 314 of the pillow shell 110, 210, 310 is formed of an unadorned or undecorated piece of fabric. In alternate embodiments, the lower surface 114, 214, 314 also includes decorative features. In other embodiments, the pillow shell 110, 210, 310 includes a conventional fastener seam, for example a zipper or hook-and-loop fastener, such that the shell can be removed, for example, for washing and cleaning. While the pillow shells depicted herein are formed entirely from fabric, alternative embodiments of the shells can be formed from alternative materials such as rubber, plastic or any other suitable flexible and child-friendly material.

In example embodiments, the pillow shell includes appendages to represent aspects of the pillow's designated character or object. For example, the elephant pillow 200 of FIG. 2 includes one appendage 216 configured to represent the elephant's trunk and two appendages 218 configured to represent the elephant's feet. The owl pillow 300 of FIG. 3 includes two appendages 316 representing the owl's ears. Additionally, stitching and/or appliqués can be used to represent aspects of the character or object. For example, the lion pillow 100 in FIG. 1 uses stitching 126 to represent the lion's eyes and the tip of the lion's nose.

Example embodiments of infant support pillows further comprise attached flaps to represent aspects of the character or object. For example, the lion pillow 100 in FIG. 1 comprises two flaps 128 attached to the outer perimeter of the lion's face 122 which represent the lion's ears. The elephant pillow 200 of FIG. 2 comprises a flap 228 configured to represent the elephant's ear. The attachment flaps 128, 228 typically contain crinkle paper or another material that makes noise when moved to enhance child development and engagement. Example embodiments of the infant support pillow also include decorative loops 129, 229, 329 for infant engagement. In alternative embodiments, the shell includes toys, loops for toy attachment, toy bars, teethers or any other attachment suitable for child entertainment or engagement. Other embodiments can further include a sound and/or vibration unit configured to be stored in an internal pocket on the shell or inside the pillow.

Figure 4:
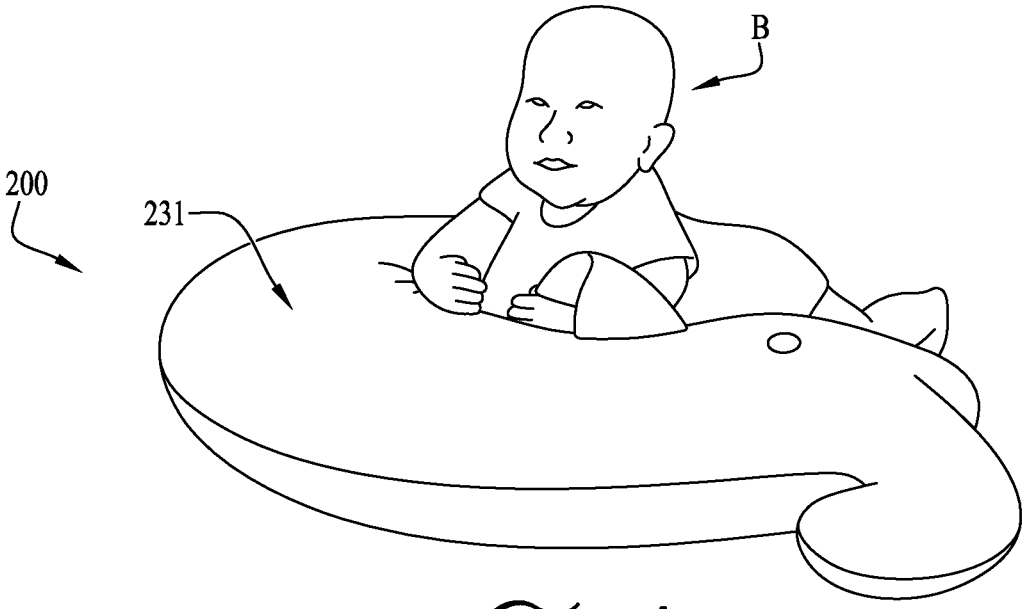
FIG. 4 shows an infant supported inclined prone on the infant support pillow of FIG. 2.
Figure 5:
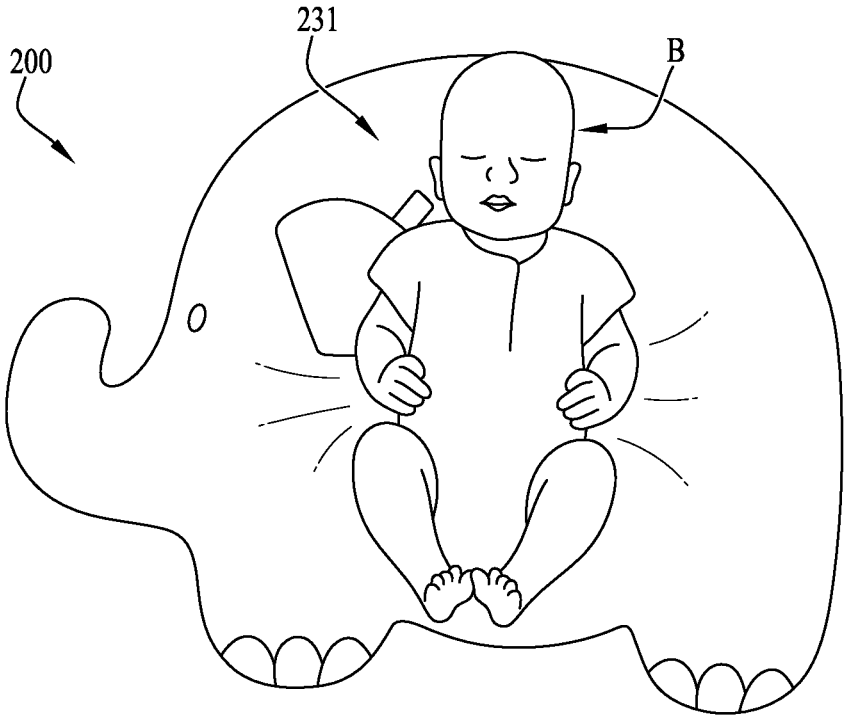
FIG. 5 shows an infant supported inclined supine on the infant support pillow of FIG. 2.
Figure 6:
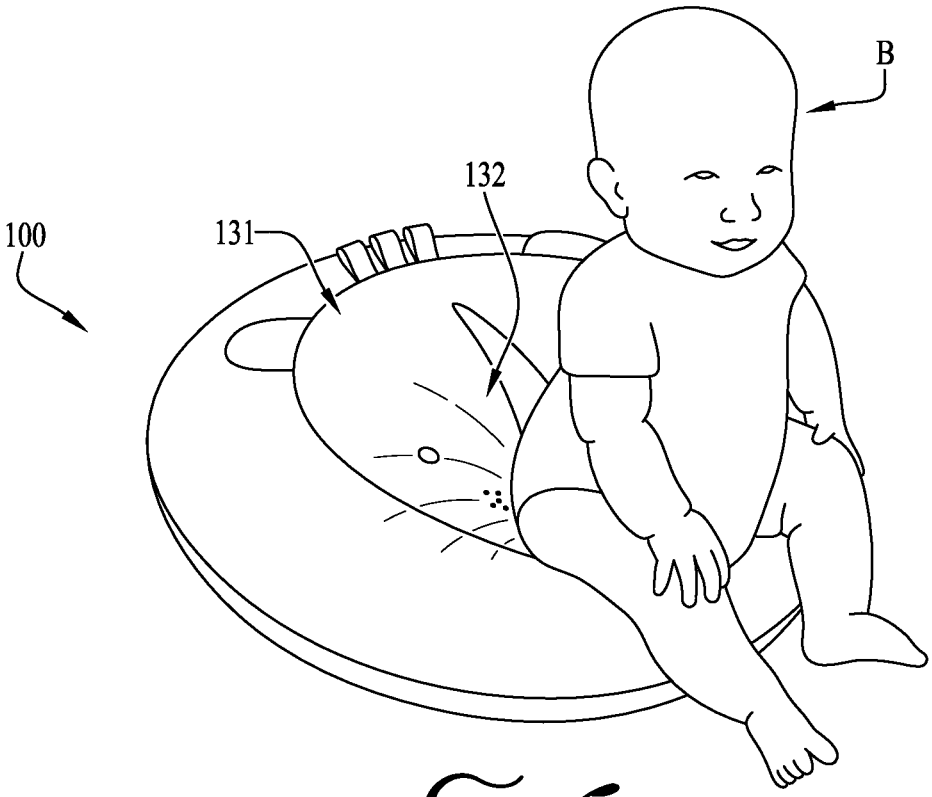
FIG. 6 shows an infant supported in a seated upright orientation on the infant support pillow of FIG. 1.
Figure 7:
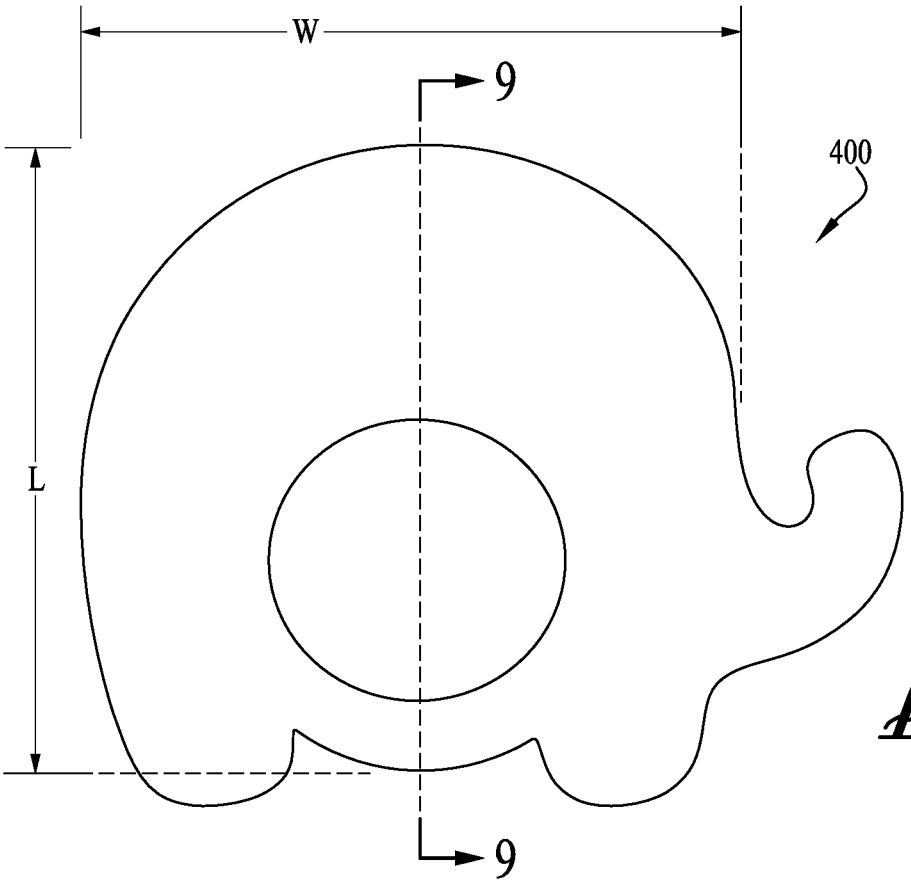
FIG. 7 shows a top view of the infant support pillow of FIG. 2.
Figure 8:
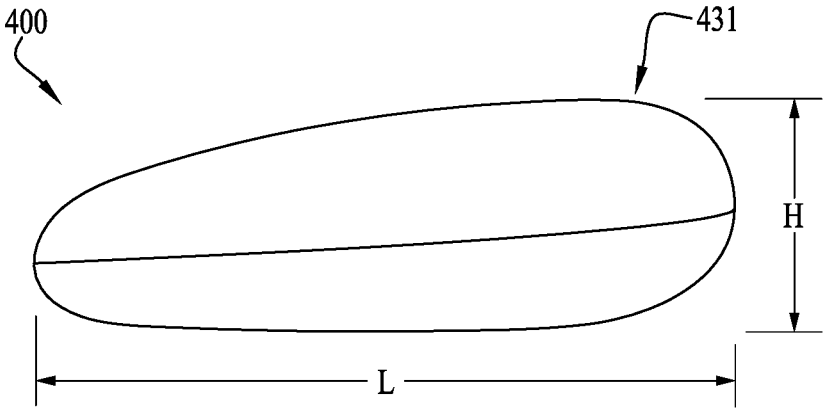
FIG. 8 is a side view of the infant support pillow of FIG. 7 shown without the appendage trunk for clarity.

As shown in FIGS. 4-6, the infant support pillow 100, 200 of these embodiments are configured to support an infant or baby B in a variety of positions including a prone, supine or seated position. As depicted in FIG. 4, the pillow 200 is configured to support an infant B when lying on the pillow facing downwards, also known as the prone position. The recessed area 230 supports the infant's stomach, lower body and legs. The raised periphery portion 131 and/or inclined portion 132 support the baby's B chest, arms and upper body. The infant support pillow 200 can also support an infant B lying on its back, as depicted in FIG. 5, also known as the supine position. The recessed center portion 230 supports the buttocks of the infant B and the raised periphery portion 131 and/or inclined portion 132 support the infant's neck and head. The pillow 100 can also support a child B in a seated position, as depicted in FIG. 6. The recessed area 130 and/or inclined portion 132 support the buttocks of the child B, helping to keep the child in an upright position. The pillow 100 also provides a cushioned area, the raised periphery portion 131 and the inclined portion 132, if the child B were to lean backwards into a supine position.

In example embodiments, the infant support pillow 400 has a length L, width W, and height H such that it can support an infant or small child. Representative dimensions are depicted on FIGS. 7 and 8. In example embodiments, the length L, indicated on FIG. 7, of the pillow 400 can be between about 12 inches and about 32 inches. In another embodiment, the length L of the pillow 400 can be between about 16 inches and about 27 inches. In still another embodiment, the length L can be between about 19 inches and about 23 inches. The infant support pillow 400 can further have a width W between about 12 inches and about 32 inches. In another embodiment, the width W of the pillow 400 can be between about 16 inches and about 27 inches. In still another embodiment, the width W can between about 19 inches and about 23 inches. In example embodiments, the height H of the pillow 400 at the highest point of its raised periphery portion 431, indicated on FIG. 8, can be between about 3 inches and about 12 inches. In another embodiment, the pillow 400 has a height H of between about 4 inches and about 10 inches. In still another embodiment, the height H of the pillow 400 can be between about 5 inches and about 9 inches.

Figure 9:
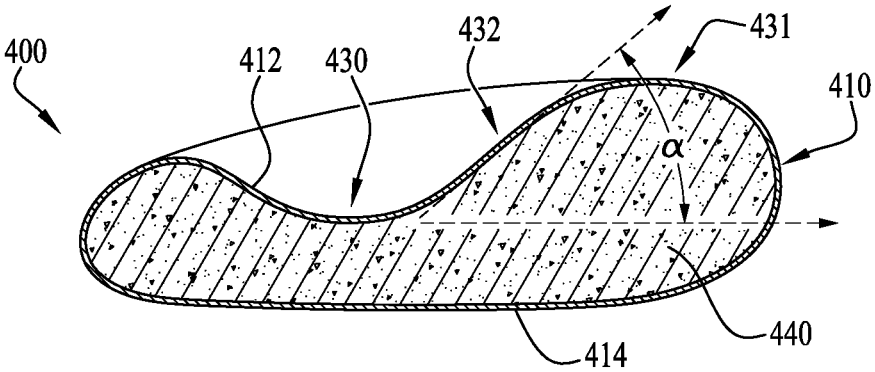
FIG. 9 is a cross section of the infant support pillow of FIG. 7 taken at line 9-9.

As shown in FIG. 9, the pillow shell contains a resilient fill material 440 such that after being compressed under a force, for example under the weight of an infant or child, the pillow 400 substantially returns to its original relaxed state and shape upon removal of the compressing force. The fill material 440 can be foam, polyfill, another conventional resiliently deformable fill material or a combination thereof. The selected fill material or combination of fill materials 440 has a density such that the pillow will support a small child or infant of at least average weight without compressing the pillow to a substantially flat shape. In example embodiments, the selected fill material or combination of fill materials 440 has a density such that the infant support pillow 400 will adhere to an example safety compress standard wherein a 2 pound weight will cause a compression of less than one inch (for eliminating/minimizing any suffocation risk). In this embodiment, the resilient fill material 440 is filled directly into the pillow shell 410. In alternate embodiments, the infant support pillow includes an inner enclosure which contains the resilient fill material. That inner enclosure is then covered by the pillow shell. The inner enclosure is preferably formed of a non-woven fabric to help smooth out the shell material.

FIG. 9 further depicts the recessed area 430, the raised periphery portion 431 and inclined transition portion 432 of the upper surface 412 of the pillow 400. The inclined transition portion 432 has a support incline angle A with respect to the support surface or floor. According to example embodiments, the angle of incline A can be between about 0 degrees and about 35 degrees. In another embodiment, the angle of incline A can be between about 6 degrees and about 18 degrees. In other embodiments, the raised perimeter portion 432 and/or recessed portion 430 can be substantially parallel with the support surface. To achieve the desired shape, the fill material 440 can be a single piece of foam. The foam can be formed (e.g., cut or molded) to create the desired shape of the upper surface 412 while maintaining a substantially flat lower surface 414. The pillow shell 410 is constructed of a flexible material such that it can substantially conform to the shape of the single piece of foam.

The distance between the top of the raised periphery portion and the bottom of the recessed area (between the top edge of the pillow and the bottom of the well) is typically about 2.5 inches to about 4 inches. Also, the distance between the side of the well and the side edge of the pillow is typically about 4 inches to about 6.5 inches. These dimensions are illustrative of example embodiments for context and thus are not in any way limiting of the invention.

In other embodiments, the resilient fill material includes a plurality of fill material pieces. In such embodiments, the pillow shell can be constructed to obtain the desired shape of the pillow. For example, the generally center portion of the upper surface of the pillow shell can be attached to the corresponding center portion of the lower surface of the pillow shell. The attachment can be formed by attachment points such as tufting points, a continuous seam, or another attachment method suitable for maintaining a connection between the upper and lower surface. To help maintain the lower surface in a generally flat profile, the lower surface can be constructed of a more rigid material than the upper surface. Further, the upper surface can be constructed of a larger piece of material than the lower surface.

Figure 10A:
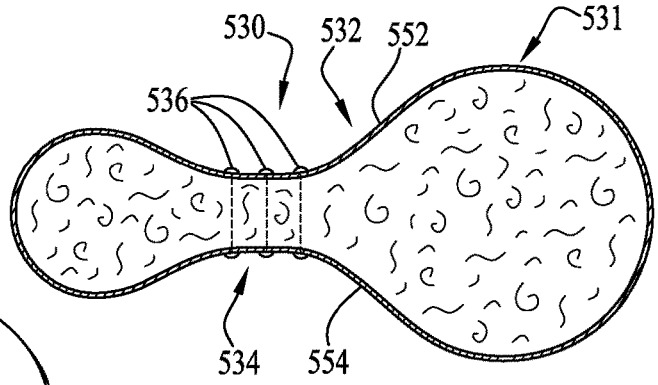
FIG. 10A shows a cross section of an inner enclosure of the infant support pillow of FIG. 10.
Figure 10:
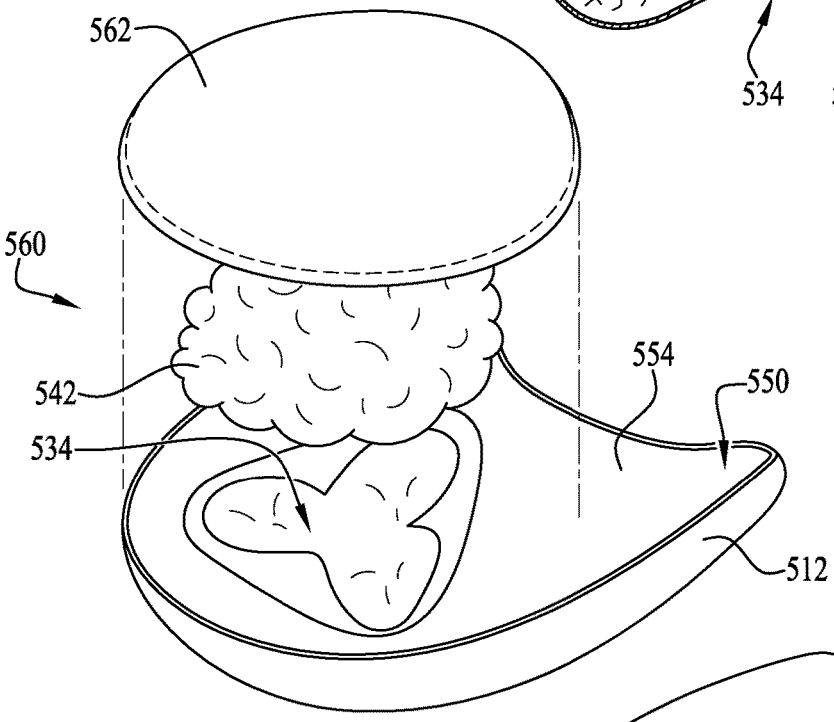
FIG. 10 is an exploded view of an infant support pillow according to another example embodiment of the present invention.
Figure 11:
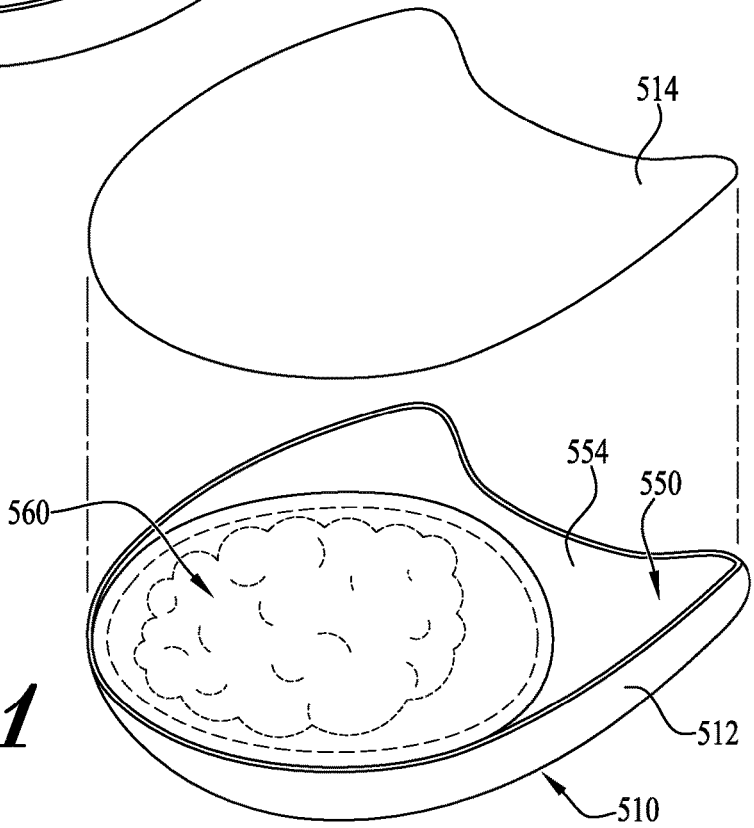
FIG. 11 shows an alternate configuration of the exploded view of the infant support pillow of FIG. 10.

FIGS. 10 and 11 show an infant support pillow 500 according to another example embodiment of the claimed invention. In this embodiment, the infant support pillow 500 includes a disk-shaped inner enclosure 550 filled with a main resilient fill material, which is not pictured, defining a recessed area 530 in its upper surface 552 and a cavity 534 in its lower surface 554. The pillow 500 also includes an insert or localized support pouch 560 positioned in the cavity 534 in the lower surface 554 of the inner enclosure 550 to support the recessed area 530 from below. The inner enclosure 550 and insert 560 can be covered and contained within a pillow shell 510.

The upper surface 552 of the inner enclosure 550 is substantially the same size and shape as the upper surface of the previously described infant support pillows. The upper surface 552 of the inner enclosure 550 is defined by a recessed area 530, an upper periphery portion 531, and an inclined transition portion 532. As shown in FIG. 10A the recessed portion 530 is formed through attachments 536 between the generally center portion of the upper surface 552 of the inner enclosure 550 and the corresponding central portion of the lower surface 554 of the inner enclosure 550. In the example embodiments, the attachments 536 are a series of tufting points, where the two surfaces 552, 554 are connected at several single points to create the desired shape and size of the recessed area 530. In alternative embodiments, the attachment can be stitching around the periphery of the recessed area 530. As shown, this attachment method of creating the recessed area 530 in the upper surface 552 of the inner enclosure 550 forms a corresponding cavity 534 in the lower surface 554 of the inner enclosure 550. In other embodiments, the upper surface of the inner enclosure can be the upper surface of the outer shell (i.e., the pillow can comprise the inner enclosure with a second partial shell covering only the bottom of the "inner enclosure.")

As depicted in FIG. 10, the cavity 534 in the lower surface 554 can be supported from below with an insert or a localized pouch 560. The insert 560 includes an insert fill material 542 and a cover flap 562. The insert fill material 542 can be poly-fill, foam, batting, or any other conventional fill material. The insert fill material 542 can be the same material or a different material as the resilient fill material in the inner enclosure 550. The insert fill material 542 is placed in the cavity 534 in the lower surface 554 of the inner enclosure 550. The flap 562 is attached to the lower surface 554 of the inner enclosure 550 so that it covers the cavity 534 and contains the insert fill material 542, as shown in FIG. 11. The inner enclosure 550 and insert 560 are covered and contained within the pillow shell 510. In alternate embodiments, the insert has a separate enclosure, for example, a flexible case containing the fill material independent of the inner enclosure. The insert is preferably a size and shape such that it covers the cavity while giving the lower surface of the infant support pillow a substantially flat profile. The insert is attached to lower surface of the inner enclosure such that it substantially fills the cavity. In other embodiments, where the infant support pillow does not contain an inner enclosure, the insert is attached directly to the pillow shell such that it supports the underside of the recessed area.

Figure 12:
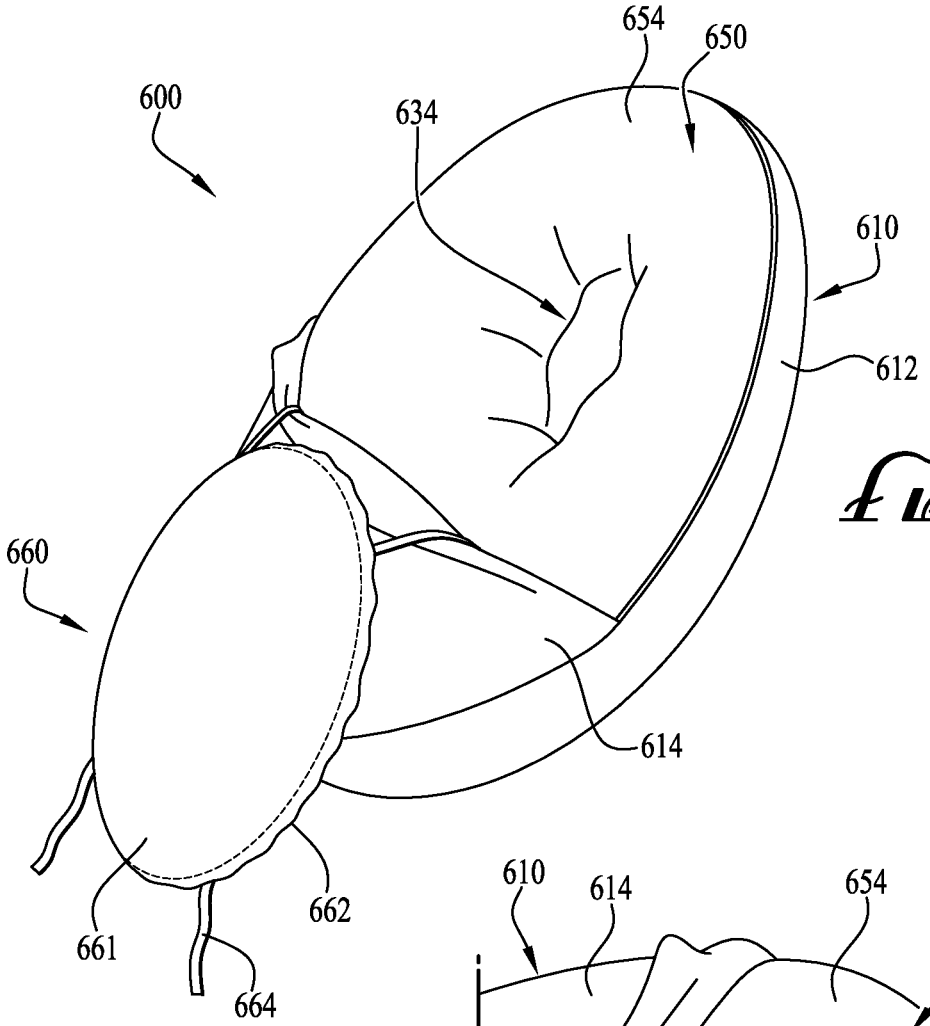
FIG. 12 is a perspective view of an infant support pillow according to another example embodiment of the present invention shown disassembled to reveal internal components.
Figure 13:
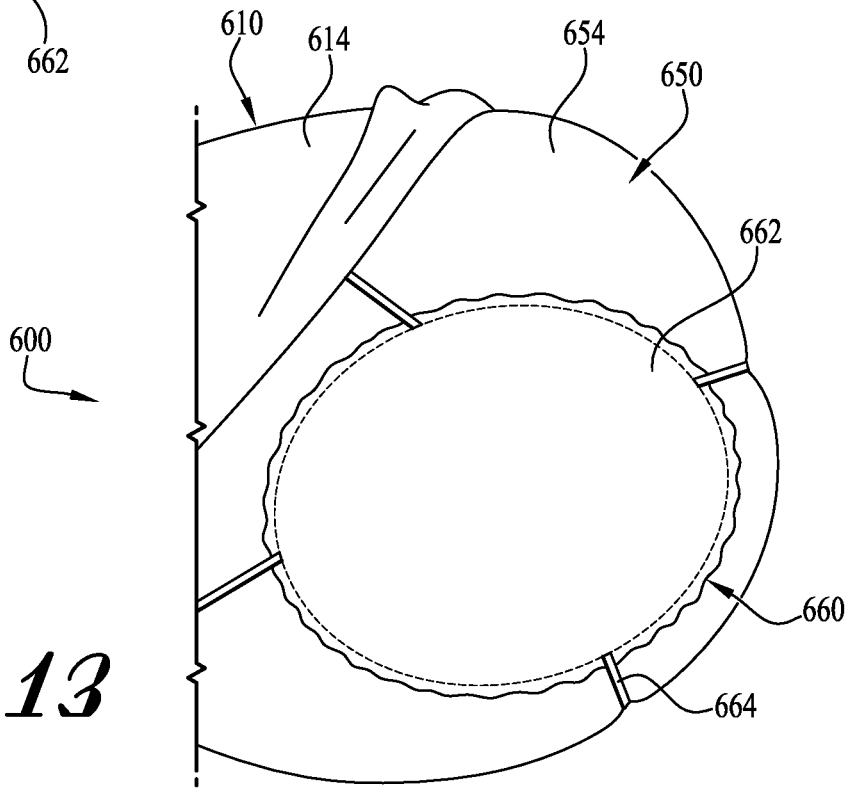
FIG. 13 shows a portion of the infant support pillow of FIG. 13, partially assembled

FIGS. 12 and 13 show an infant support pillow 600 according to another example embodiment of the claimed invention. In this embodiment, the infant support pillow 600 includes an inner enclosure 650 with a recessed area in the upper surface (not pictured) and a cavity 634 in the lower surface 654, similar to that described in the previous embodiment. The pillow 600 also includes an insert 660 designed to support the cavity 634 in the lower surface 654 of the inner enclosure 650 and a shell 610 to cover the inner enclosure and insert. In example embodiments, the insert 660 has a generally disk shape created from two pieces of fabric 661, 662 which are attached together at their outer periphery to form a flexible case which contains an insert fill material. The insert fill material can include poly-fill, foam, batting, or any other conventional fill material. The insert 660 is positioned such that it covers the cavity 634 in the lower surface 654 of the inner enclosure 650. The insert 660 is held in position by four straps 664 attached at one end to the perimeter of the insert and at the other end to the perimeter of the inner enclosure 650. The straps 664 are preferably constructed of an at least partially elastic material such that the insert 660 will remain substantially centered in the cavity 634 created by the recessed area 630 and be less likely to rip or detach during normal use of the pillow 600. In alternate embodiments, a different number or configuration of straps 664 are used. In other embodiments, the straps are attached at one end to the insert and at the other end directly to the pillow shell. In other embodiments, the insert has any shape such that is consistent with the shape of the cavity. In other embodiments, the insert is attached to the shell 610 or inner enclosure by other conventional attachments The weight of the example infant support pillows can be between about 300 grams and about 1800 grams. In another example embodiment, the weight of the pillow can be between about 450 grams and about 1400 grams. In yet another example embodiment, the weight of the pillow can be between about 700 grams and about 1300 grams. As will be understood by one of ordinary skill in the art, the weight of the pillow can differ significantly depending upon the types of materials used for the shell, fill material, etc.

In its various embodiments, the infant support pillow of the present invention is created by conventional methods of manufacture. In example methods the pillow shell is formed from at least two pieces of material, the upper surface is formed from at least one piece of material and the lower surface is formed from at least a second piece of material. A portion of the perimeter of the first piece of material is attached to a perimeter portion of the second piece of material. In alternate embodiments, the pillow shell further includes a medial band or one or more panels coupling the upper surface to the lower surface. The fill material can be machine blown into the shell, the shell can be hand-filled, or the shell can be filled by a combination of hand and machine filling.

In example embodiments, attachment and couplings between fabrics and features is accomplished through sewing. Methods include hand sewing and machine sewing to create attachments and couplings. In example embodiments where sewing is used as the method of attachment, the stitches per inch can be between about 3 and about 18 stitches per inch. According to other embodiments, the stitches per inch can be between about 4 and about 16 stitches per inch. In another embodiment, the stitches per inch can be between about 6 and about 14 stitches per inch. In alternate embodiments fabrics and features are glued or otherwise coupled together.

In example embodiments, where the fill material is contained within the pillow shell itself without a separate inner enclosure, the recessed area or seat well is created directly in the pillow shell. The upper surface is attached to the lower surface to create the recessed area. Fill material is retained between the upper surface and lower surface in the recessed area. In example embodiments, a continuous seam 133 creates the recessed area in the desired shape, as depicted in FIG. 1. In alternate embodiments, the upper and lower surface of the shell are attached through a series of tufting points 236, 336 arranged to create the desired size and shape of the seat well, depicted in FIGS. 2 and 3. In other embodiments, gusseting or other methods of attachment can be used. In example embodiments where the infant support pillow comprises an inner enclosure containing the fill material, separate from the pillow shell, the recessed area is created in the inner enclosure. The top surface of the inner enclosure and bottom surface of the inner enclosure are attached in the same methods as described above. In example embodiments, the corresponding portion of the upper and/or lower surface of the pillow shell is attached to the recessed area created in the inner enclosure. In alternate embodiments, the pillow shell is not permanently attached to the inner enclosure.

Figure 14:
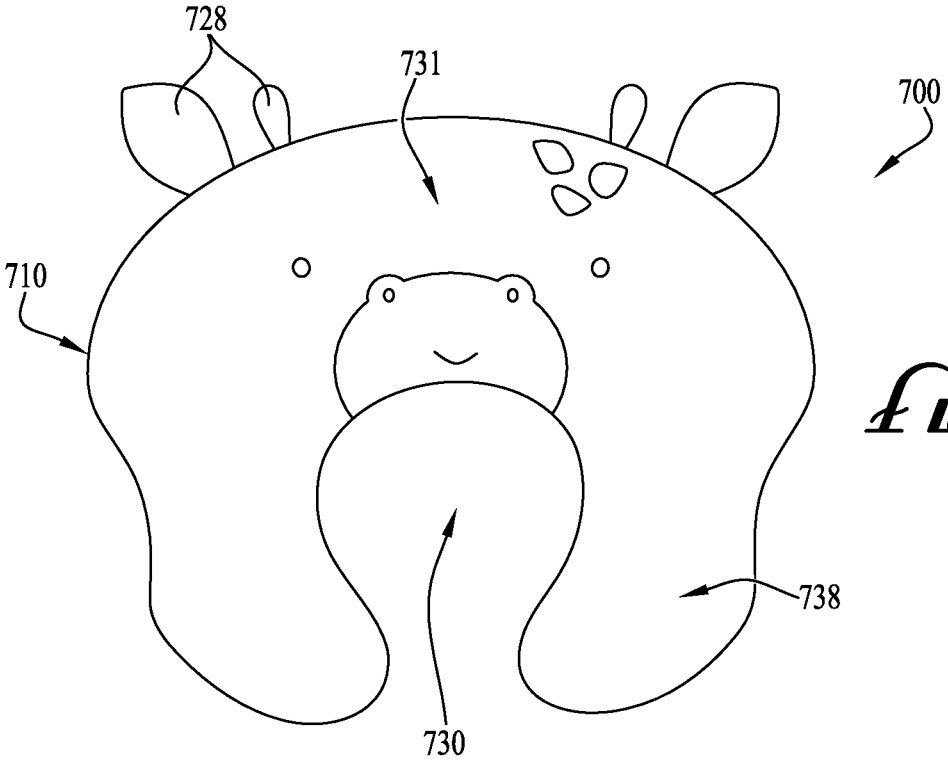
FIG. 14 is a top view of an infant support pillow according to another example embodiment of the present invention in its in use position.

FIG. 14 shows an infant support pillow 700 according to another example embodiment of the invention. In this embodiment, the raised periphery portion of the pillow 700 is defined by a medial region 731, two opposing arms 738 extending from the medial region. The central area within the periphery of the pillow is defined by an open well or void 730. The infant support pillow 700 is configured to support an infant on the lap of a caregiver during breast feeding or bottle feeding. In example embodiments, the medial region 731 is configured to rest on the caregiver's lap and support the infant's entire body. The opposing arms 738 are configured to wrap around the caregiver's waist. The infant support pillow 700 is also configured to support an infant in the prop position, where the legs of the child are positioned in the open well 730 and the medial region 731 supports the child's head and neck.

The infant support pillow 700 comprises a fill material contained or covered by a pillow shell 710. In example embodiments, the fill material comprises a single piece of foam formed to the U-shape of the infant support pillow 700. In alternate embodiments, the fill material comprises polyfill or another conventional fill material. The pillow shell 710 can be configured to resemble a character or object, for example, in this embodiment, a giraffe. In the example embodiment, an appliqué is applied to the medial region 731 of the pillow 700 to represent the giraffes face. In alternate embodiments, the pillow shell 710 comprises different pieces of fabric to represent the aspects of the character or object. The infant support pillow 700 further comprises attachments 728 to represent other aspects of the giraffe, including ears and horns.

Figure 15:
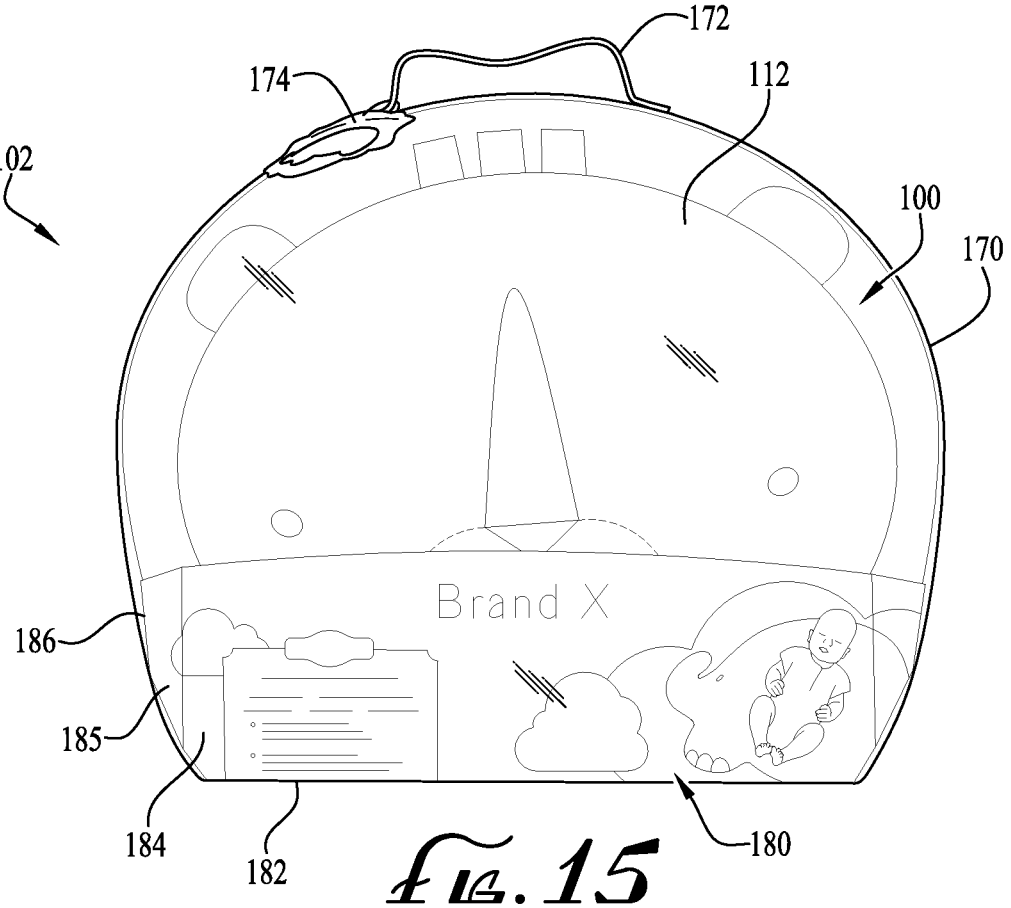
FIG. 15 is a front view of a packaging assembly containing the infant support pillow of FIG. 1 in its storage position.
Figure 16:
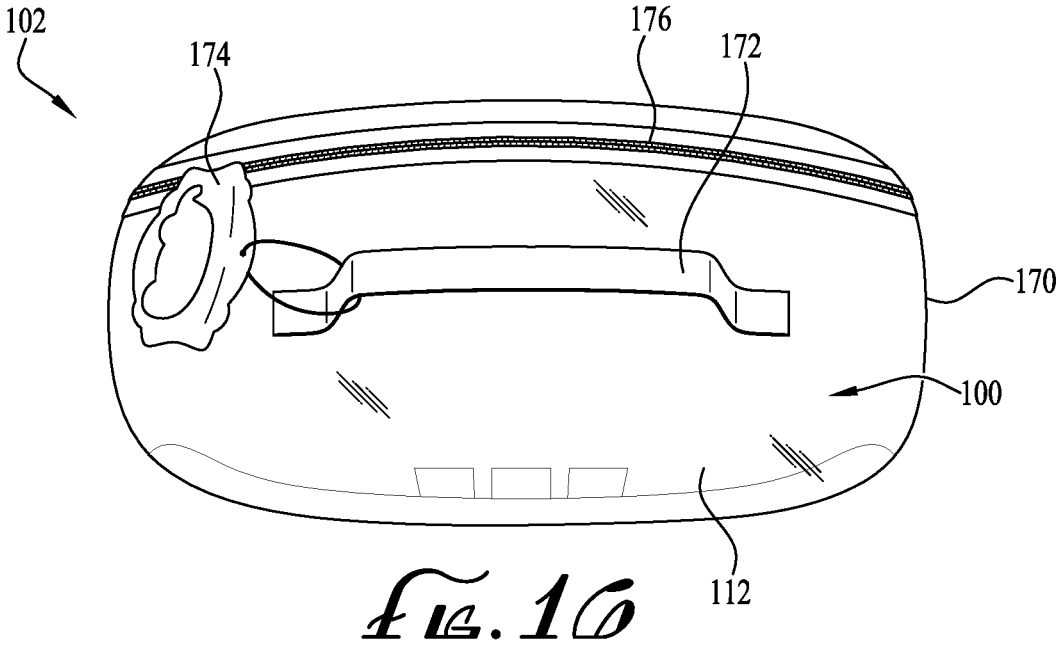
FIG. 16 shows a top view of the packaging assembly of FIG. 15.
Figure 17:
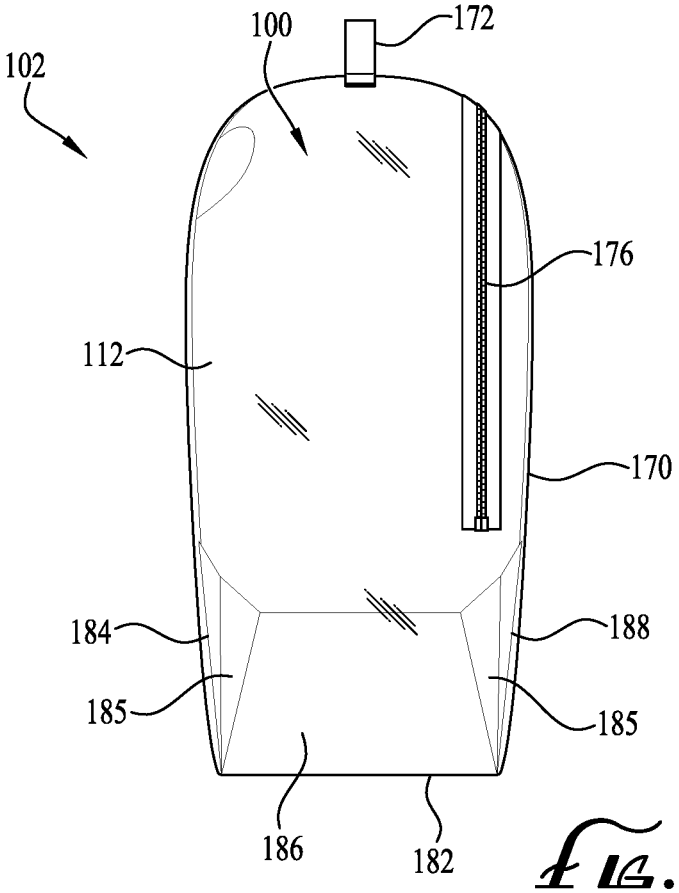
FIG. 17 shows a side view of the packaging assembly of FIG. 15.

FIGS. 15-17 shows a packaging assembly 102 for the pillow 100 of FIG. 1. As shown, the packaging assembly 102 comprises a tray 180 positioned inside of a bag 170 configured to contain the infant support pillow 100. In preferred embodiments, the bag 170 is substantially clear allowing a purchaser to see a portion of the pillow 100 it contains. The tray 180 and bag 170 preferably support the infant support pillow 100 in a vertical position in which the infant support pillow is standing on its outer peripheral end and the upper support surface 112 is generally perpendicular to the floor. The upper support surface 112 is thus oriented such that the character or object depicted (or at least a portion of it, e.g., above the tray) on the pillow is visible to a purchaser viewing the packaging assembly 102 standing upright on a store shelf.

The tray 180 can be formed from cardboard, corrugated cardboard, or another suitably sturdy material for supporting the pillow and the bag containing it in the vertical storage position when placed on a flat surface. The bag 170 is formed from vinyl, or another suitably flexible material. Preferably, the bag 170 is formed of a clear or substantially see-through material. The tray 180 includes at minimum a front wall 184 a back wall 188 and at least one connection therebetween. The front wall 184 and back wall 188 can be connected by a base 182 configured to rest on a support surface and the stood-on peripheral end of the pillow 100 rests on the base. The front and back walls 184, 188 can be further connected by sidewalls 186. Other embodiments can be configured without a base 182, without sidewalls 186, or without a portion of the sidewalls. A portion of the pillow 100 is received within the tray 180 and the bag 170 is configured to receive the tray and the pillow. Optionally, the bag 170 includes a handle 172 to facilitate carrying the bag. Optionally, a sale or label tag 174 is attached to the bag, for example to the handle 172.

In example embodiments, the side walls 186, front walls 184, and/or back wall 188 are tapered to generally match a tapered contour of the pillow 100 in a nesting arrangement. For example, the area created by the upper peripheral edge of the tray 180 can be larger than the area of the base 182. In general, the upper peripheral edge of the tray 180 creates a polygonal shape. In example embodiments, the tray 180 further includes triangular corner panels 185 between the front wall 184 and the sidewalls 186 and between the back wall 188 and the side walls. Each of the corner panels 185 connects at a widest point to a top corner of the front wall 184 or back wall 188 and the adjacent top corner of a sidewall 186. The corner panel 185 tapers downward and connects at a point to a corner of the base 182. A lower point of each triangular corner panel 185 forms a lower corner of the tray 180 and the opposite top side of the panel form an upper edge of the upper peripheral edge of the tray. In other embodiments, the corner panels 185 further include at least one fold line 187 extending from the point where the corner panel connects to the base 182 to a point along the upper edge. The fold line 187 allows the tray 180 to extend in both a front-to-back and side-to-side direction to receive the infant support pillow 100 in the nested arrangement.

According to example embodiments, the height of the sidewalls 186, the front wall 184, and the back wall 188 can be between about 0.5 inches and about 10 inches. In another embodiment, the height can be between about 2 inches and about 7 inches. The width of the sidewalls 186 can be between about 2 inches and about 10 inches. In another embodiment, the width of the sidewalls 186 can be between about 3 inches and about 8 inches. The width of the front 184 and back walls 188 can be between about 12 inches and about 32 inches. In another embodiment, the width of the front 184 and back wall 188 can be between about 16 inches and 27 inches. Optionally, the width of the sidewalls 186 at their widest point can be slightly less than the greatest height of the pillow 100 portion disposed therein. Also optionally, the width of the front 184 and back walls 188 at their widest point can be less than the greatest width of the pillow 100 portion disposed therein. The snug fit between the tray 180 and the pillow 100 serves to stabilize the assembly 102 and prevent it from tipping over.

In example embodiments, the dimensions of the bag 170 substantially match the dimensions of the pillow 100. For example, the height of the bag 170 can be between about 12 inches and about 32 inches, the width can be between about 12 inches and about 32 inches, and the depth of the bag can be between about 3 inches and about 12 inches. The dimensions of the bag 170 can differ slightly from the pillow 100 to accommodate the tray. In alternate embodiments, the bag can be sized slightly smaller than the tray 180 and pillow 100, creating a snug fit between the bag and the tray and pillow to further stabilize the assembly 102.

The bag 170 includes an opening 176 through which the tray and pillow 100 can be inserted and removed. In example embodiments, the opening 176 is releasably closed via a flap, zipper, snaps, hook and loop fastener, or another fastener. In one example, the bag 170 can be formed from a vinyl material and a vinyl flap can be positioned adjacent the opening 176. The vinyl flap can cover the opening 176 and can stick to the vinyl bag 170 to retain the opening in a closed position. In alternate embodiments, the opening 176 is not sealable.

Figure 18:
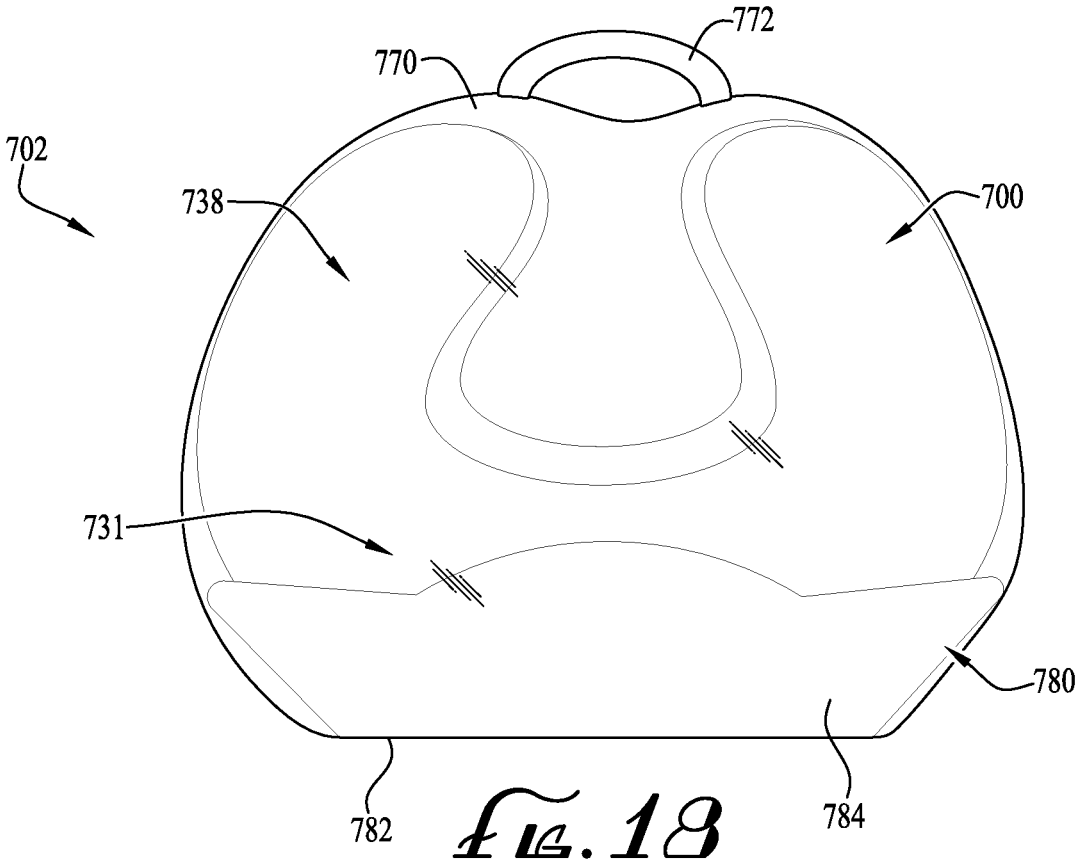
FIG. 18 is a front view of a packaging assembly containing the infant support pillow of FIG. 14.
Figure 19:
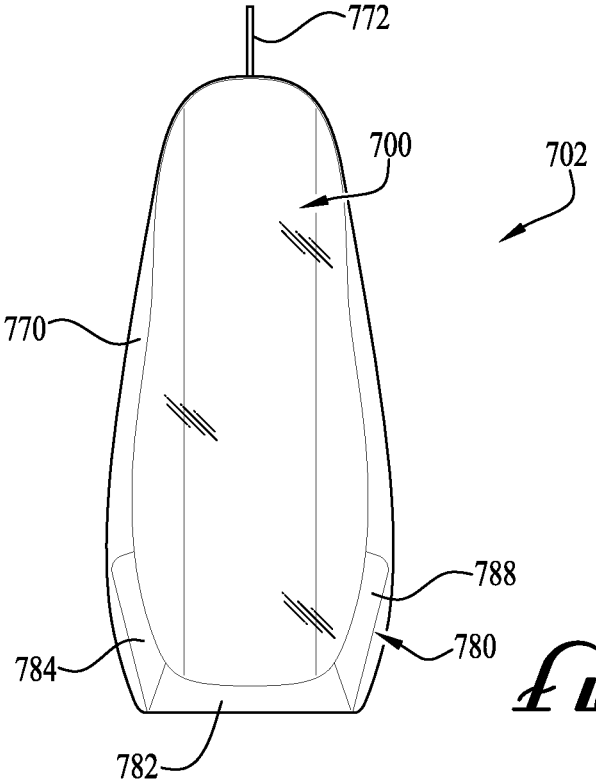
FIG. 19 shows a side view of the packaging assembly of FIG. 18.

FIGS. 18 and 19 show a packaging assembly 702 for the pillow 700 of FIG. 14. The packaging assembly 702 includes a tray 780 and a bag 770 similar to those described above. However, the sidewall enclosure comprises a front wall 784 and a back wall 788 only. In such embodiments, the tray 780 can be constructed of a more rigid material than that used to construct a tray in which the sidewall enclosure has at least four walls. In alternate embodiments, the tray 780 further includes strips of material (not pictured) extending between each upper corner of the front wall 784 and the corresponding corner of the back wall 788 in order to provide support in the front-to-back direction. The strips can be constructed of the same material as the tray 780 or a different material including paper, elastic, rope, cable or any other material suitable to maintain the connection between the front wall 784 and back wall 788 when the pillow is inserted between them. As shown, the pillow 700 is oriented with its medial region 731 positioned at the bottom of the bag 770 and the ends of its arms 738 positioned at the top of the bag. This configuration creates a more stabilized assembly 602.

While the example embodiments depict a pillow with a generally disc shape, other shapes can be used. For example, other shapes contemplated in the preset invention include other regular and irregular shapes representing other animals, objects, characters, and symbols.

While the invention has been described with reference to preferred and example embodiments, it will be understood by those skilled in the art that a variety of modifications, additions and deletions are within the scope of the invention, as defined by the following claims.

What is claimed is:

1. An infant support pillow, comprising:

a pillow shell including an upper surface, a lower surface, a first end, and a second end; and a resilient fill material contained within the shell, wherein the shell and the fill material form a raised peripheral portion extending about at least a portion of a periphery of the upper surface of the pillow and a recessed portion in a generally central area of the pillow within the raised peripheral portion, wherein the raised peripheral portion has a length and a width each between about 12 inches and about 32 inches, wherein each side of the recessed portion is between 4 inches and about 6.5 inches from the periphery of the upper surface of the pillow such that the recessed portion is sized to support an infant's lower body, wherein the raised peripheral portion is higher at the first end than at the second end, and wherein the shell lower surface is generally flat such that the shell lower surface rests generally flush on a support surface, wherein the resilient fill material has a density such that the fill material will support a child or infant without compressing the infant support pillow to a substantially flat shape, wherein an approximately two pound compressing force compresses the fill material less than one inch between the upper surface and the lower surface.

2. The infant support pillow of claim 1, wherein the shell and fill material further form an inclined transition portion between the recessed portion and the raised peripheral portion.

3. The infant support pillow of claim 2, wherein the inclined transition portion has an angle of incline between about 6 degrees and about 18 degrees.

4. The infant support pillow of claim 1, wherein at least a portion of the shell upper surface is configured to resemble a character or object.

5. The infant support pillow of claim 4, wherein the pillow shell includes a plurality of fabrics configured to represent features of the character or object.

6. The infant support pillow of claim 5, wherein at least two of the plurality of fabrics have different textures.

* * * * *